US008393921B1

(12) United States Patent
Chiu et al.

(10) Patent No.: US 8,393,921 B1
(45) Date of Patent: Mar. 12, 2013

(54) RECEPTACLE CONNECTOR

(75) Inventors: Wen-Ta Chiu, New Taipei (TW); Wen-Shuan Shih, New Taipei (TW)

(73) Assignee: Chant Sincere Co., Ltd., New Taipei (TW)

( * ) Notice: Subject to any disclaimer, the term of this patent is extended or adjusted under 35 U.S.C. 154(b) by 0 days.

(21) Appl. No.: 13/315,620

(22) Filed: Dec. 9, 2011

(51) Int. Cl.
*H01R 24/00* (2011.01)

(52) U.S. Cl. ..... 439/660

(58) Field of Classification Search ..... 439/660, 439/887, 607.34, 607.35, 607.11, 607.05, 439/733.1, 638
See application file for complete search history.

(56) References Cited

U.S. PATENT DOCUMENTS 6,942,525 B2 * 9/2005 Olson et al. ..... 439/660
7,798,832 B2 * 9/2010 Qin et al. ..... 439/188
7,997,927 B2 * 8/2011 Wan et al. ..... 439/541.5
8,011,966 B1 * 9/2011 Tang et al. ..... 439/638
8,033,869 B1 * 10/2011 Zhu et al. ..... 439/660
8,100,720 B2 * 1/2012 Lin et al. ..... 439/607.34
2005/0186850 A1 * 8/2005 Tsai ..... 439/660
2007/0218772 A1 * 9/2007 Chiang ..... 439/660
2011/0059656 A1 * 3/2011 Tsai ..... 439/660
2011/0076895 A1 * 3/2011 Zheng et al. ..... 439/660
2011/0281468 A1 * 11/2011 Yu et al. ..... 439/660
2011/0287666 A1 * 11/2011 Nishi et al. ..... 439/660

* cited by examiner

*Primary Examiner* — Jean F Duverne
(74) *Attorney, Agent, or Firm* — Bacon & Thomas, PLLC

(57) ABSTRACT

A receptacle connector relates to a connector with sets of contacts arranged in at least one row, providing a solution to install supplementary terminal. As the plug connector plugging in the opening of the shell into the receiving room which is configured between the opening and the insulative housing which is enveloped at the shell, the contact zone at front end of the plug terminal connects with the contact of the principal terminal of the set of principal terminal and the tip of the supplementary terminal. A loop is so generated whereas electrically connecting the principal terminal and the supplementary terminal, wherein the tip and the contacts are all exposed in the receiving room, thereby providing a bridge between the soldering tail of the principal terminal and the soldering tail of the supplementary terminal transmitting auxiliary signal to the host board of the electric machine system.

10 Claims, 5 Drawing Sheets

RECEPTACLE CONNECTOR

BACKGROUND OF THE INVENTION

1. Field of the Invention

The present invention relates generally to a receptacle connector, and more specifically, to a receptacle connector in which having sets of contacts arranged in at least one row, wherein providing a solution to install supplementary terminal.

2. Description of the Related Art

The past word "Technology" cannot compare with the present. Nowadays, Computer-peripheral devices and equipments are closely stepped with the innovation, especially those consumer electronics in the household appliance market. The market of portable devices or personal computers is concentrating every single one of middle class which having power to buy.

As we think about the technology again, are these electronic components supplied to minimized electric machines going to minimizing, too? The answer is true. Therefore, the connector maker, ever itself considered the precision industry, never quits pursuing more than fine skills and designs. In recent years, the mating space of connectors has been reduced to a height between 2 mm and 5 mm.

FIGS. 1-3 illustrate a socket having a switch terminal enabling to switch on the computer. The socket is configured at a computer, comprising: a metal shielding 10 configuring a protruded grounding tab 12 at one inner sidewall and having a front opening 11; and a plastic housing having a tongue 20 is configured in said metal shielding 10; and a switch terminal 30 and a plurality of signal terminals are configured in said metal shielding 10, wherein said switch terminal 30 configuring a trigger 31 protruded to said metal shielding 10. When a connector plug 50 inserted to said metal shielding 10, said trigger 31 and said grounding tab 12 are electrically connecting with a shell 51 of said connector plug 50 and further configuring a loop, so that said switch terminal 30 pass a signal into a control circuit of computer, thereof, switching on the computer.

Said socket, providing the electrical connection between a trigger of auxiliary terminal and an inner sidewall of metal shielding, is not directly connected to generate a signal, but configures an electrical connection by the plug metal shell as a conductive body. The so-called signal terminal and switch terminal, in designer's thinking, are referred to distinguish between the principal function terminal and the supplementary function terminal. The principal function terminal is generally to provide signal transmission and grounding for host board required by written standards. The supplementary function terminal as being an auxiliary signal component for electric machine system is generally to be a detect pin for securing the plug stable insertion or a switch terminal for switching on/off an electric machine or supplying/cutting electric power.

However, the previous art that configuring an electrical connection by a conductive body such as the plug metal shell, does not apply in all practices. In recent years, the function of supplementary terminal has failed due to simplifying the design of metals, or alternative using polyethylene resin composition as substitute in several portable storage devices. The other previous art was using a pair of supplementary terminals as a loop wherein a plug insulative housing pressed to one supplementary terminal, and made it forward to touch the other supplementary terminal, further configuring a loop, so that trying to fix all drawbacks. However, these ideas seem to perform poor—less than ideal.

SUMMARY OF THE INVENTION

Therefore, the present invention is directed to an improved receptacle connector in which having sets of contacts arranged in at least one row, wherein providing a solution to install supplementary terminal.

A receptacle connector comprises a shell having an opening, and an insulative housing being enveloped in said shell and defining at least one receiving room to said opening.

a set of first principal terminals is disposed in said insulative housing and includes a plurality of first principal terminals wherein each of said first principal terminal having a contact at front end and a soldering tail at rear end thereby arranging contacts of said first principal terminals in single row. A set of second principal terminals is disposed in said insulative housing and includes a plurality of second principal terminals wherein each of said second principal terminal having a contact at front end and a soldering tail at rear end thereby arranging contacts of said second principal terminals in single row. A supplementary terminal is disposed in said insulative housing wherein said supplementary terminal having a tip at front end and a soldering tail at rear end; and said tip of said supplementary terminal and said contacts of said principal terminals are all exposed in said receiving room.

As a plug connector plugging via said opening into said receiving room, a contact zone at front end of said plug terminal electrically connects with the contact of said second principal terminal and also electrically connects with said tip of said supplementary terminal, configuring a loop between said second principal terminal and said supplementary terminal, thereby providing a bridge between the soldering tail of said second principal terminal and said soldering tail of said supplementary terminal transmitting auxiliary signal to a host board embedded in a electric machine system.

DETAILED DESCRIPTION OF THE EMBODIMENTS)

Figure 2:
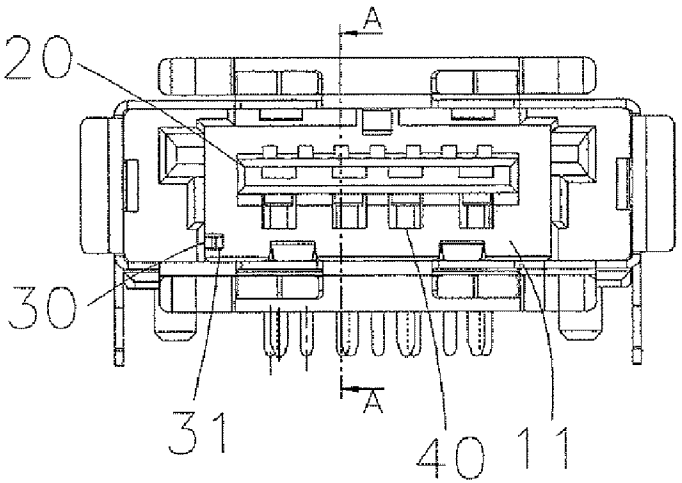
FIG.2 Prior Art
FIG. 2 is a front view of a known socket shown in FIG. 1.
Figure 1:
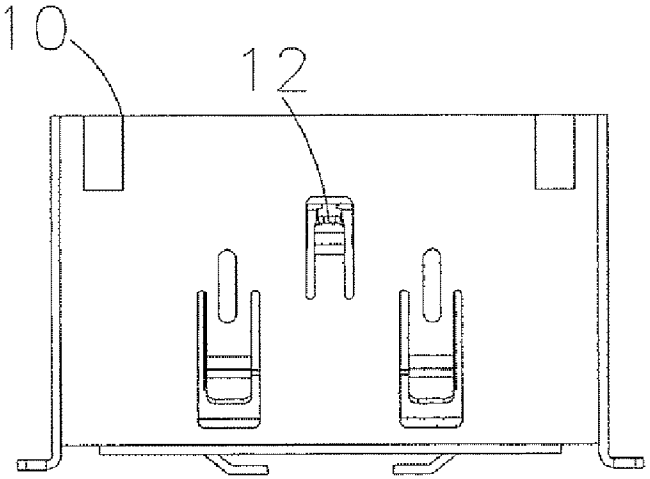
FIG.1 Prior Art
FIG. 1 is a vertical view of a known socket illustrating a switch terminal to which the present invention is directed.
Figure 4:
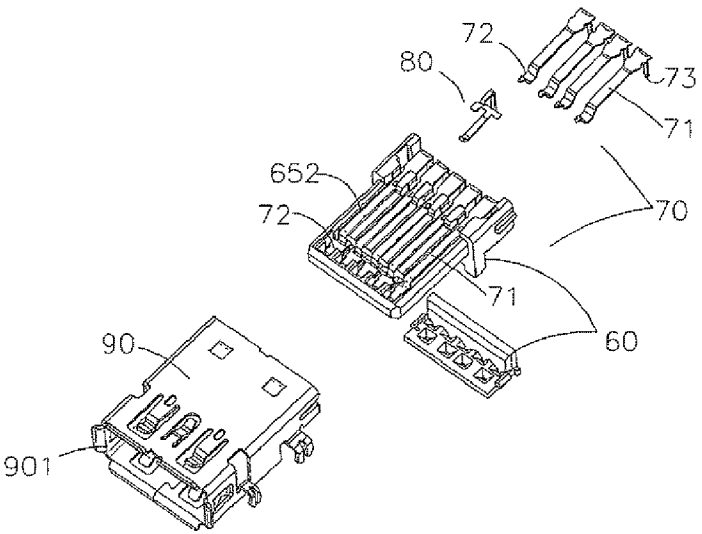
FIG. 4 is an exploded perspective view of the receptacle connector formed in accordance with an embodiment of the invention.
Figure 3:
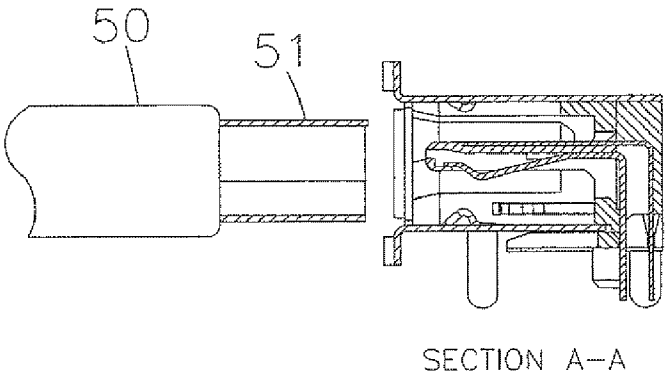
FIG.3 Prior Art
FIG. 3 is a cross-section view of a known socket taken along line A-A shown in FIG. 2.

The present invention relates to a receptacle connector, especially to a receptacle connector with sets of contacts arranged in at least one row, providing a solution to install supplementary terminal.

Referring to FIGS. 4-10, a receptacle connector 900 comprises: an insulative housing 60, a set of first principal terminals 700, a set of second principal terminals 750, a supplementary terminal 80 and a shell 90. An opening 901 is defined at the front end of the shell 90 for a plug connector 95 to plug in. Another opening 901 is defined at the rear end of the shell 90 for receiving the insulative housing 60.

The insulative housing 60 is assembled into the shell 90 and enveloped by the shell 90. A receiving room 902 is defined between the insulative housing 60 and the front end opening 901. The receiving room 902 is not limited to only a receiving room 902 in the present invention. A manufacturer can define more than a receiving room 902 for receiving those plug connectors with different size and shape to plugged in. All words referred to "terminal" or "contact" gave hereby are defined as metallic unless a contrary statement.

Figure 6:
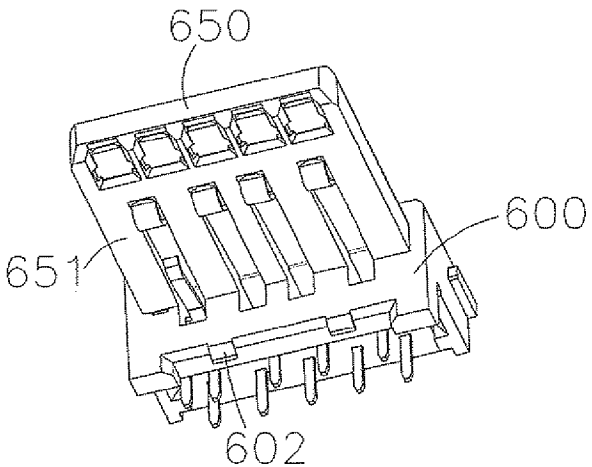
FIG. 6 is a perspective view of the insulative housing of the receptacle connector shown in FIG. 4.

As shown in FIG. 6, the insulative housing 60 usually are configured to a base 600 and a mating portion 650. The base 600 is used to mount the rear portion of the terminals and to tightly assemble to the shell 90. The surface of the base 600 is approximately larger than the surface of the mating portion 650 so that the base 600 is easily to configure protrudes or apertures. The mating portion 650 providing an exposing area for front ends of the terminals are usually designed to two types for example, one is to expose terminals and the other is to coat terminals.

Figure 8:
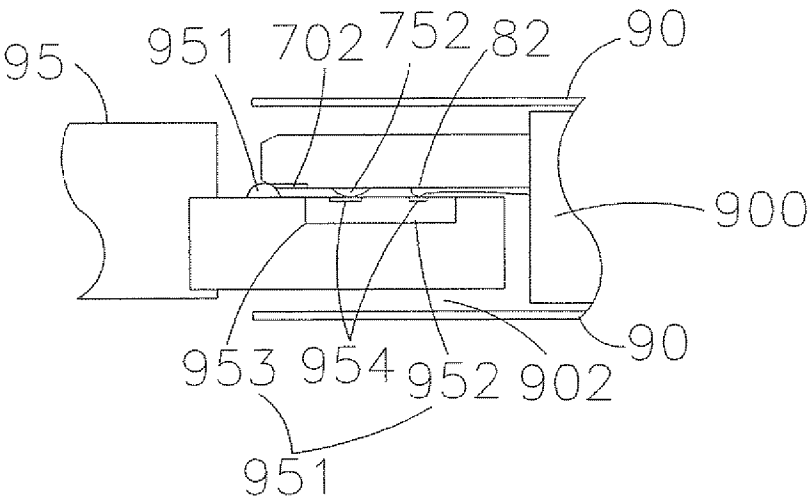
FIG. 8 is a cross-section view of the receptacle connector connecting with a plug connector in accordance with an embodiment of the invention.

In the first type, the mating portion 650 and the receiving room 902 are simply configured to a slot for receiving the terminals inserted from the outside, e.g. a slot of card connector (not shown). In the second type, the mating portion 650 is configured as a tongue 651. The tongue 651 envelopes the terminals body so that only front end contacts of the terminals are exposed out. As shown in FIG. 8, the receiving room 902 is defined between the tongue 651 and the opening 901 of the shell 90 for a plug connector 95 to plugging in. The front ends of plug terminals 951 are extending into the receiving room 902.

The receptacle connector 900 has at least one set of principal terminals 70. In preferred embodiment, there are two set of principal terminals 70. The set of first principal terminals 700 and the set of second principal terminals 750 comprise a plurality of principal terminals 71 which are configured on the insulative housing 60. The principal terminal 71 may be assembled to the insulative housing 60 or be insert-molded to the insulative housing 60. In preferred embodiment, the principal terminals 71 are assembled to the insulative housing 60.

Figure 5:
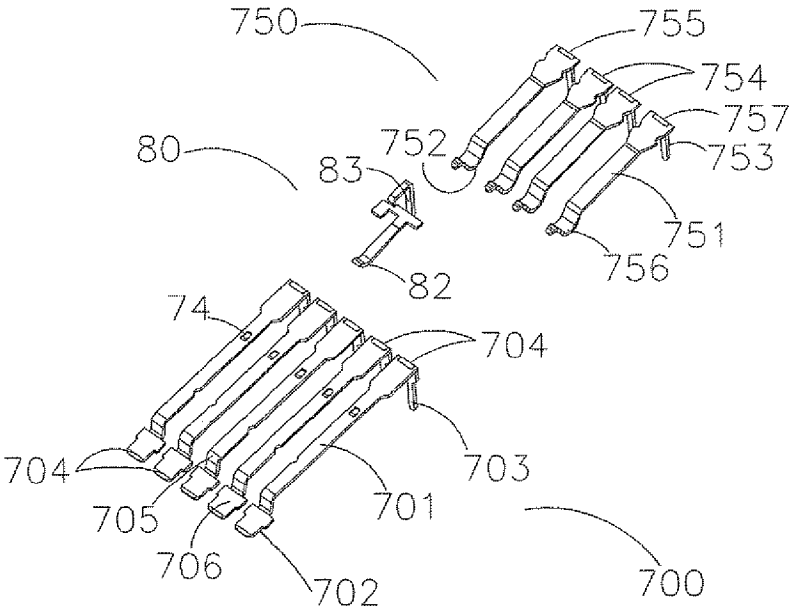
FIG. 5 is an exploded perspective view of the terminals of the receptacle connector shown in FIG. 4.

As shown in FIG. 5, The principal terminal 71 forms the front end as a geometric shape including a contact 72, 702, 752 and the rest being enveloped in a recession 652 of the insulative housing 60. A protrude 74 is selectively configured at body of the principal terminal 71 for intervening the recession 652. At least one channel 601 communicating with the receiving room 902 is configured at the base 600 of the insulative housing 60, wherein the principal terminals 71 are passed through the channel 601 and (the unpassed portion) are adjusted, by hand-tools, to the bottom of the insulative housing 60 defining the rear end of the principal terminals 71.

The rear end of the principal terminal 71 includes a soldering tail 73, 703, 753 which is used to solder, press-fit or "via" to mount on a host board 961, thus, becomes a part of the host board 961 and an input/output unit of an electric machine system 962 transmitting signals. The rest of the rear end of the principal terminal 71 is enveloped in a recession 652 of the insulative housing 60. In preferred embodiment, the insulating housings 60 consist of parts, more than one and the principal terminals 71 are enveloped by different parts, one part enveloped the rear end of the principal terminal 71 so-called "stopper".

The front end of the set of first principal terminals 700 is disposed upon the tongue 651 closed to the tongue 651 front end and placed at the front to the front opening 901, thus the plug terminals 951 can contact or pass the set of first principal terminals 700 firstly as the plug connector 95 is plugging in. In the preferred embodiment, the set of first principal terminals 700 includes two pair high speed differential signal principal terminals 704 and one ground principal terminal 705 which is disposed in the center of the two pair differential signal principal terminals 704. Each of first principal terminals 701 contains a plate 706 at front end, which is defined as a contact 702.

The front end of the set of second principal terminals 750 is disposed upon the tongue 651 closed to the base 600, and meanwhile closed to the set of first principal terminals 700 in opposite direction, wherein the set of second principal terminals 750 been closer to the base 600 more than the set of first principal terminals 700. Thus the plug terminals 951 can selectively firstly or secondly contact the set of second principal terminals 750 or as the plug connector 95 is plugging in. In the preferred embodiment, the set of second principal terminals 750 includes a pair high speed differential signal principal terminal 754, one ground principal terminal 755 which is disposed in one side of the pair differential signal principal terminals 754, and one power principal terminal 757 which is disposed in the other side. Each of second principal terminals 751 contains a resilient portion at front end, precisely referred to an arc 756, defined as a contact 752, at tip of the arc 756.

Figure 7:
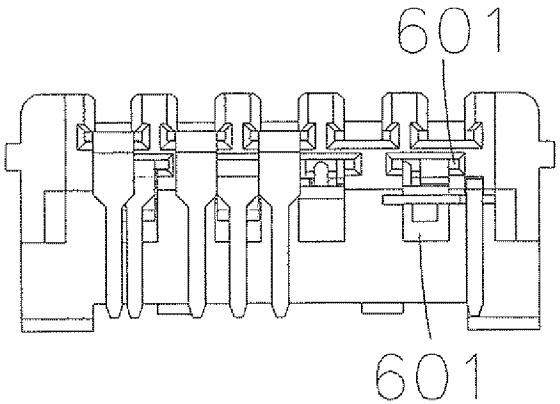
FIG. 7 is a rear view of details of the insulative housing of the receptacle connector shown in FIG. 6.

The supplementary terminal 80 is configured in insulative housing 60 and forms the front end as a geometric shape including a tip 82. As assembling of the principal terminal 71, the supplementary terminal 80 is assembled via the channel 601 into the receiving room 902. The channel 601 is selectively providing an exclusive way for the supplementary terminal 80 or sharing space with the principal terminal 71, as shown in FIG. 7. The unpassed portion is adjusted, by hand-tools, to the bottom of the insulative housing 60 defining the rear end of the supplementary terminal 80. The rear end of the supplementary terminal 80 includes a soldering tail 83 which is used to solder, press-fit or "via" to mount on a host board 961, thus, becomes a part of the host board 961 and an auxiliary unit of an electric machine system 962, for example: a detect pin for securing the plug connector 95 stable insertion or a switch terminal for switching on/off an electric machine system 962 or supplying/cutting electric power.

The front end of the supplementary terminal 80 is disposed upon the tongue 651 closed to the base 600, and meanwhile closed to the set of second principal terminal 750 in opposite direction, wherein the supplementary terminal 80 been closer to the base 600 more than the set of second principal terminal 750. Thus the plug terminals 951 can secondly or thirdly contact the supplementary terminal 80 as the plug connector 95 is plugging in.

The tip 82 of the supplementary terminal 80 and the contacts 72 of the principal terminals 71 are all exposed in the receiving room 902. In the preferred embodiment, the tip 82 of the supplementary terminal 80 is disposed corresponding to the contact 752 of the ground principal terminal 755 of the set of second principal terminals 750, thereby engaging/accommodating the plug terminal 951 to/in the tip 82 and the contact 752. As the plug connector 95 plugging in the receiving room 902, a contact zone 952 at front end of the plug terminal 951 firstly contacts the contact 752 of the ground principal terminal 755 wherein the plug terminal 951 being inserted to position of the set of second principal terminal 750. The contact zone 952 also contacts the tip 82 of the supplementary terminal 80 wherein the plug terminal 951 being continually moved to position of the supplementary terminal 80 and the contact zone 952 of the plug terminal 951 still contacted the contact 752.

As shown in FIG. 8, the contact zone 952 of the plug terminals 951 contains a metal plate 953 at front end, which is defined as two endpoints 954, or a resilient arc, defined as two contacts (not shown). The contact zone 952 at front end of the plug terminal 951 not only connects with the contact 752 of the ground principal terminal 755 but also the tip 82 of the supplementary terminal 80. A loop is so generated whereas electrically connecting the ground principal terminal 755 of the set of second principal terminal 750 and the supplementary terminal 80, and provides a bridge between the soldering tail 753 of the ground principal terminal 755 and the soldering tail 83 of the supplementary terminal 80 transmitting auxiliary signal to the host board 961 of the electric machine system 962.

Figure 10:
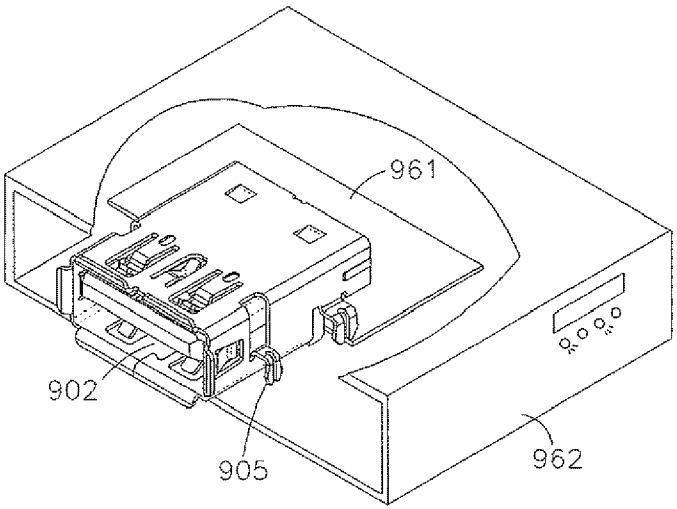
FIG. 10 is a perspective view of the digital card adapter standby in accordance with an embodiment of the invention.
Figure 9:
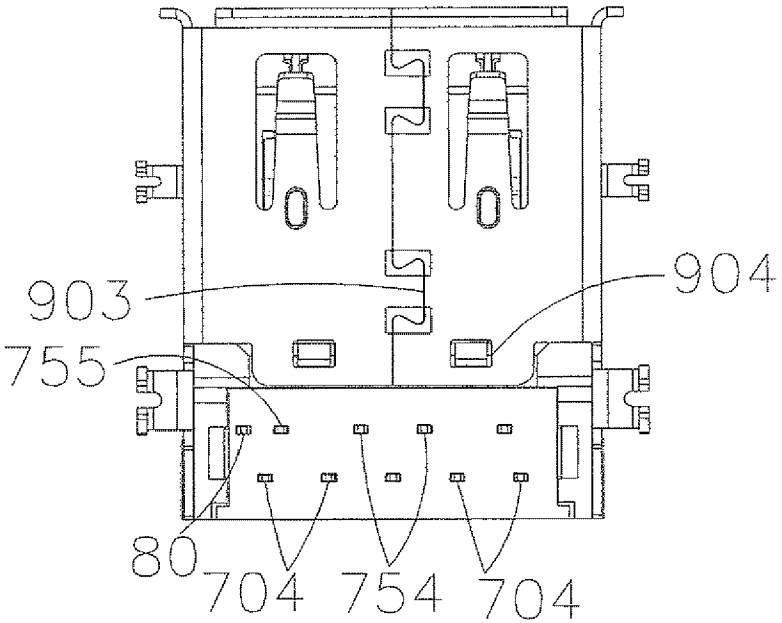
FIG. 9 is an upward view of the receptacle connector formed in accordance with an embodiment of the invention.

As shown in FIG. 9, the shell 90 is made of the metal for providing stronger strength and electromagnetic shielding. First, by a stamping machine, the shell 90 is shaped and forms a flat metal slice on tape (not shown) then, by hands, the slice, took off from tape, is bent as a rectangular body and finished at a closed portion 903 under the rectangular body. An aperture 904 is disposed on the shell 90 and connected to a tab 602 on the insulative housing 60. More than one aperture 904 may be configured to the shell 90 for providing fixed assembling to the insulative housing 60 as shown in FIGS. 9-10. The shell 90, at two sides, includes soldering legs 905 which are used to solder, press-fit or "via" to mount on a host board 961, thus, becomes a part of the host board 961 and an input/output unit of an electric machine system 962.

As shown in FIG. 9, the receptacle connector of the present invention relates to a receptacle connector with sets of contacts arranged in at least one row, providing a solution to install supplementary terminal. As the plug connector 95 plugging in the opening 901 of the shell 90 into the receiving room 902 which is configured between the opening 901 and the insulative housing 60 which is enveloped at the shell 90, the contact zone 952 at front end of the plug terminal 951 not only connects with the contact 752 of the principal terminal 71 of the set of principal terminal 70 but also the tip 82 of the supplementary terminal 80. A loop is so generated whereas electrically connecting the principal terminal 71 and the supplementary terminal 80, wherein the tip 82 and the contacts 72 are all exposed in the receiving room 902, thereby providing a bridge between the soldering tail 73 of the principal terminal 71 and the soldering tail 83 of the supplementary terminal 80 transmitting auxiliary signal to the host board 961 of the electric machine system 962.

While the invention has been described in terms of various specific embodiments, those skilled in the art will recognize that the invention can be practiced with modification within the spirit and scope of the claims.

What is claimed is:

1. A receptacle connector, comprising:

a shell having an opening; and an insulative housing being enveloped in said shell and defining at least one receiving room to said opening; and a set of first principal terminals including a plurality of first principal terminals disposed in said insulative housing wherein each of said first principal terminal having a contact at front end and a soldering tail at rear end thereby arranging contacts of said first principal terminals in single row; and a set of second principal terminals including a plurality of second principal terminals disposed in said insulative housing wherein each of said second principal terminal having a contact at front end and a soldering tail at rear end thereby arranging contacts of said second principal terminals in single row; and a supplementary terminal disposed in said insulative housing wherein said supplementary terminal having a tip at front end and a soldering tail at rear end; and all said tip of said supplementary terminal and said contacts of said principal terminals being exposed in said receiving room; and as a plug connector plugging via said opening into said receiving room, a contact zone at front end of said plug terminal electrically connecting with the contact of said second principal terminal and also electrically connecting with said tip of said supplementary terminal, configuring a loop between said second principal terminal and said supplementary terminal, thereby providing a bridge between the soldering tail of said second principal terminal and said soldering tail of said supplementary terminal transmitting auxiliary signal to a host board embedded in a electric machine system.

2. The receptacle connector of claim 1, wherein the front end of said set of second principal terminals being closed to said opening and being near said set of first principal terminals, and said set of second principal terminals being closer to a base of said insulative housing more than said set of first principal terminals; and said plug terminals being firstly contacting to said second principal terminals as said plug connector plugging in.

3. The receptacle connector of claim 2, wherein the front end of said set of first principal terminals being closed to said opening and being the first row in front of said opening, and said set of first principal terminals being at the front end of a tongue of said insulative housing; and said plug terminals being no contact to said first principal terminals as said plug connector plugging in.

4. The receptacle connector of claim 3, wherein the front end of said supplementary terminal being closed to said set of second principal terminals, and said supplementary terminal being closer to a base of said insulative housing more than said set of second principal terminals; and said plug terminals being contacting to said supplementary terminals after contacting said second principal terminals.

5. The receptacle connector of claim 1, wherein said set of second principal terminals including a pair of high speed differential signal principal terminal, a ground principal terminal disposed in one side of said differential pair, and a power principal terminal disposed in the other side of said differential pair; and each of said second principal terminals containing a resilient portion at front end as a contact.

6. The receptacle connector of claim 5, wherein said resilient portion being an arc, and said contact being configured at tip of said arc.

7. The receptacle connector of claim 5, wherein said tip of said supplementary terminal being disposed corresponding to said contact of said ground principal terminal, thereby engaging the plug terminal to said tip and said contact.

8. The receptacle connector of claim 7, wherein said contact zone of said plug terminal firstly contacting said contact of said ground principal terminal as said plug terminal being inserted to position of said set of second principal terminal.

9. The receptacle connector of claim 8, wherein said contact zone next contacting said tip of said supplementary terminal as said plug terminal being continually moved to position of said supplementary terminal, at the same time, said contact zone still contacting with said contact.

10. The receptacle connector of claim 1, wherein said supplementary terminal being assembled via a channel into said receiving room, and said channel selectively providing an exclusive way for said supplementary terminal or sharing space with said principal terminals.

* * * * *